US012285841B2

(12) United States Patent
Lee et al.

(10) Patent No.: US 12,285,841 B2
(45) Date of Patent: Apr. 29, 2025

(54) AUTOMATIC ABRASION COMPENSATION SYSTEM OF LOWER PLATE AND WAFER LAPPING APPARATUS HAVING THE SAME

(71) Applicant: SK SILTRON CO., LTD., Gumi-si (KR)

(72) Inventors: Jae Pyo Lee, Gumi-si (KR); Seong Cheol Jeong, Gumi-si (KR); In Joon Jung, Gumi-si (KR)

(73) Assignee: SK SILTRON CO., LTD., Gyeongsangbuk-do (KR)

( * ) Notice: Subject to any disclaimer, the term of this patent is extended or adjusted under 35 U.S.C. 154(b) by 302 days.

(21) Appl. No.: 17/984,537

(22) Filed: Nov. 10, 2022

(65) Prior Publication Data

US 2023/0211457 A1 Jul. 6, 2023

(30) Foreign Application Priority Data

Jan. 6, 2022 (KR) ..... 10-2022-0002208

(51) Int. Cl.
*B24B 37/34* (2012.01)
*B24B 37/005* (2012.01)
*B24B 37/30* (2012.01)

(52) U.S. Cl.
CPC ..... *B24B 37/345* (2013.01); *B24B 37/005* (2013.01); *B24B 37/30* (2013.01)

(58) Field of Classification Search
CPC ..... B24B 37/08; B24B 37/042; B24B 37/28; B24B 49/06; B24B 49/10; B24B 53/017; B24B 37/30; B24B 37/34; B24B 37/345; B24B 49/003; B24B 49/04; B24B 49/045; H01L 21/68707
USPC ..... 451/5, 9, 10, 17, 22, 25, 262, 286, 397, 451/398
See application file for complete search history.

(56) References Cited

FOREIGN PATENT DOCUMENTS

| | | | |
|---|---|---|---|
| JP | H07-227756 | | 8/1995 |
| JP | 2004072067 A | * | 3/2004 |
| KR | 10-0919391 | | 9/2009 |
| KR | 10-1846771 | | 4/2018 |
| KR | 10-2020-0017676 | | 2/2020 |

(Continued)

*Primary Examiner* — C. A. Rivera
(74) *Attorney, Agent, or Firm* — KED & ASSOCIATES, LLP

(57) ABSTRACT

Disclosed are an automatic abrasion compensation system of a lower plate and a wafer lapping apparatus having the same. The automatic abrasion compensation system reduces wafer misloading and errors in wafer loading inspection occurring when the distance between the lower plate and a transfer robot is gradually increased due to abrasion of the lower plate during a lapping process. The automatic abrasion compensation system includes an ultrasonic sensor provided on the transfer robot, a jig located directly under the ultrasonic sensor and mounted on the lower plate, a controller configured to acquire measurement distance information by measuring a distance from the jig through the ultrasonic sensor, to compare the measurement distance information with set reference distance information and to generate an adjustment control signal, and a driver configured to automatically adjust a Z-axis position of the transfer robot depending on the adjustment control signal transmitted by the controller.

3 Claims, 4 Drawing Sheets

(56) References Cited

FOREIGN PATENT DOCUMENTS

| | | | |
|---|---|---|---|
| KR | 10-2248009 | | 5/2021 |
| KR | 10 2021 0082363 | * | 7/2021 |

* cited by examiner

AUTOMATIC ABRASION COMPENSATION SYSTEM OF LOWER PLATE AND WAFER LAPPING APPARATUS HAVING THE SAME

CROSS-REFERENCE TO RELATED PATENT APPLICATIONS

This application claims the benefit of Korean Patent Application No. 10-2022-0002208, filed on Jan. 6, 2022, which is hereby incorporated by reference as if fully set forth herein.

BACKGROUND OF THE INVENTION

Field of the Invention

The present invention relates to an automatic abrasion compensation system of a lower plate and a wafer lapping apparatus having the same, and more particularly, to an automatic abrasion compensation system of a lower plate which reduces wafer misloading and errors in wafer loading inspection occurring when the distance between the lower plate and a transfer robot configured to load and unload wafers on and from the lower plate is gradually increased due to abrasion of the lower plate during a lapping process, and a wafer lapping apparatus having the same.

Discussion of the Related Art

In general, a silicon wafer is widely used as a material for manufacturing semiconductor devices, and is referred to as a thin single crystal silicon slice formed using polycrystalline silicon as a raw material.

Such a wafer is manufactured by growing a silicon ingot formed of polycrystalline silicon, and then performing a slicing process in which the silicon ingot is sliced into the form of the wafer, a lapping process in which the wafer is planarized to have a uniform thickness, an etching process in which damage caused by mechanical polishing is removed or relieved, a polishing process in which the surface of the wafer is smoothed, and a cleaning process in which the wafer is cleaned.

Among these processes, in the lapping process, wafers are located between an upper plate and a lower plate, a slurry is injected between the upper and lower plates between which the wafers are interposed, and, when the upper and lower plates are rotated, the wafers are rotated and revolved, and are thus lapped through the slurry.

FIG. 1 is a conceptual view illustrating the wear status of a lower plate between a transfer robot and the lower plate in a conventional lapping system, and portion 'A' (a shaded portion) indicates the wear part of the lower plate.

Referring to FIG. 1, as the transfer robot loads and unloads wafers on and from the lower plate through 300 mm lapping equipment automation, the lower plate becomes thinner due to friction between the lower plate and an abrasive during the lapping process, and thus, the distance between the transfer robot and the lower plate is gradually increased.

Therefore, Z-axis directional teaching of the position of a wafer by the transfer robot is distorted, and thereby, wafer misloading and an error in distance measurement using an ultrasonic sensor occur, and may thus reduce efficiency of equipment and increase a loss ratio.

RELATED ART DOCUMENT

Patent Document

Korean Patent Registration No. 10-2248009

SUMMARY OF THE INVENTION

Accordingly, the present invention is directed to an automatic abrasion compensation system of a lower plate and a wafer lapping apparatus having the same that substantially obviate one or more problems due to limitations and disadvantages of the related art.

An object of the present invention is to provide an automatic abrasion compensation system of a lower plate which may improve wafer misloading and errors occurring in wafer loading inspection, and a wafer lapping apparatus having the same.

To achieve these objects and other advantages and in accordance with the purpose of the invention, as embodied and broadly described herein, an automatic abrasion compensation system of a lower plate, configured to uniformly adjust a distance between the lower plate and a transfer robot configured to load and unload wafers on and from the lower plate, includes an ultrasonic sensor provided on the transfer robot, a jig located directly under the ultrasonic sensor and mounted on the lower plate, a controller configured to acquire measurement distance information by measuring a distance from the jig through the ultrasonic sensor, to compare the measurement distance information with set reference distance information, and to generate an adjustment control signal, and a driver configured to automatically adjust a Z-axis position of the transfer robot depending on the adjustment control signal transmitted by the controller.

The automatic abrasion compensation system may further include a jig transfer unit configured to load and unload the jig on and from the lower plate.

The reference distance information may be distance information between the ultrasonic sensor and the jig mounted on the lower plate, initially measured after replacement with the lower plate.

The measurement distance information may include the reference distance information and a wear thickness of the lower plate, and the Z-axis position of the transfer robot may be adjusted to be moved downwards by the wear thickness of the lower plate.

The jig may be mounted in a hole formed in a carrier coupled to the lower plate.

In another aspect of the present invention, there is provided a wafer lapping apparatus having the automatic abrasion compensation system having the above-described characteristics.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
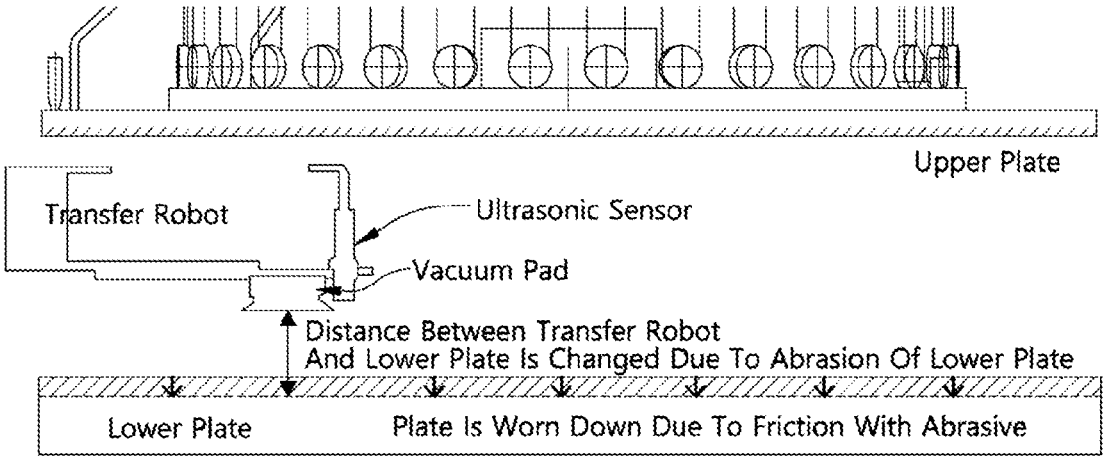
FIG. 1 is a conceptual view showing the wear status of a lower plate between a transfer robot and the lower plate in a conventional lapping system.

Hereinafter, embodiments of the present invention will be described in detail with reference to the accompanying drawings.

In the drawings, elements may be exaggerated in size, omitted, or illustrated schematically for convenience in description and clarity. Further, the sizes of elements do not indicate the actual sizes of the elements. Wherever possible, the same reference numerals will be used throughout the drawings to refer to the same parts.

Figure 2:
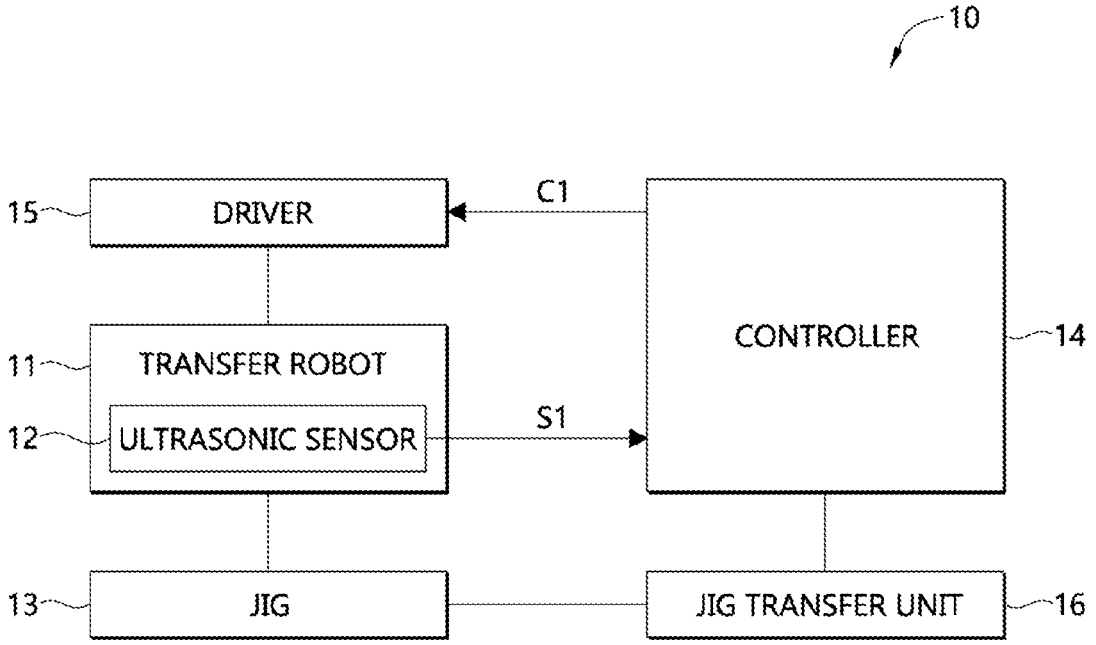
FIG. 2 is a block diagram of an automatic abrasion compensation system of a lower plate according to one embodiment of the present invention.
Figure 3:
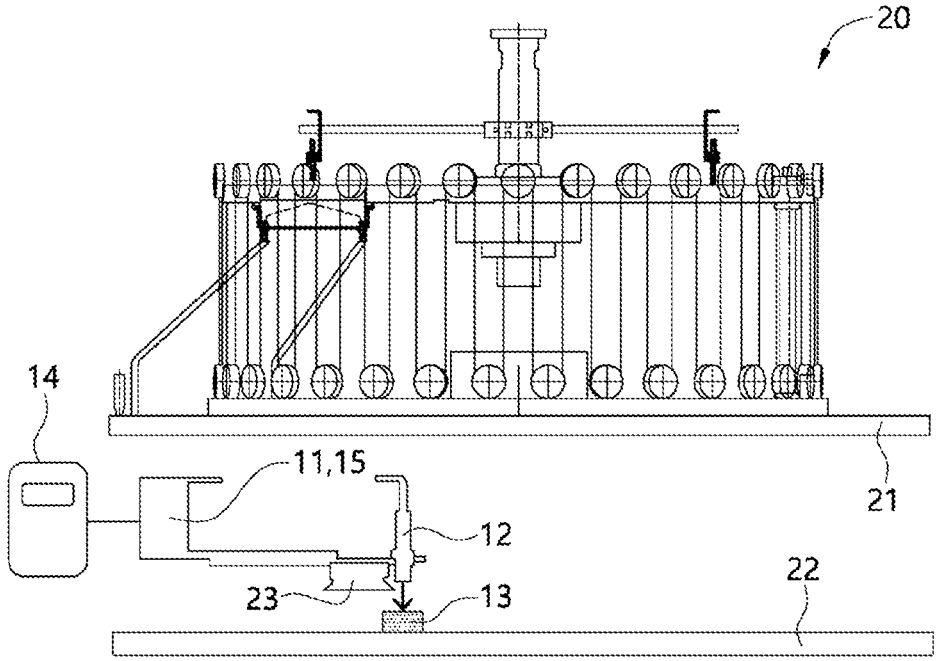
FIGS. 3 and 4 are conceptual views illustrating the use states of a wafer lapping apparatus having the automatic abrasion compensation system according to the present invention.
Figure 4:
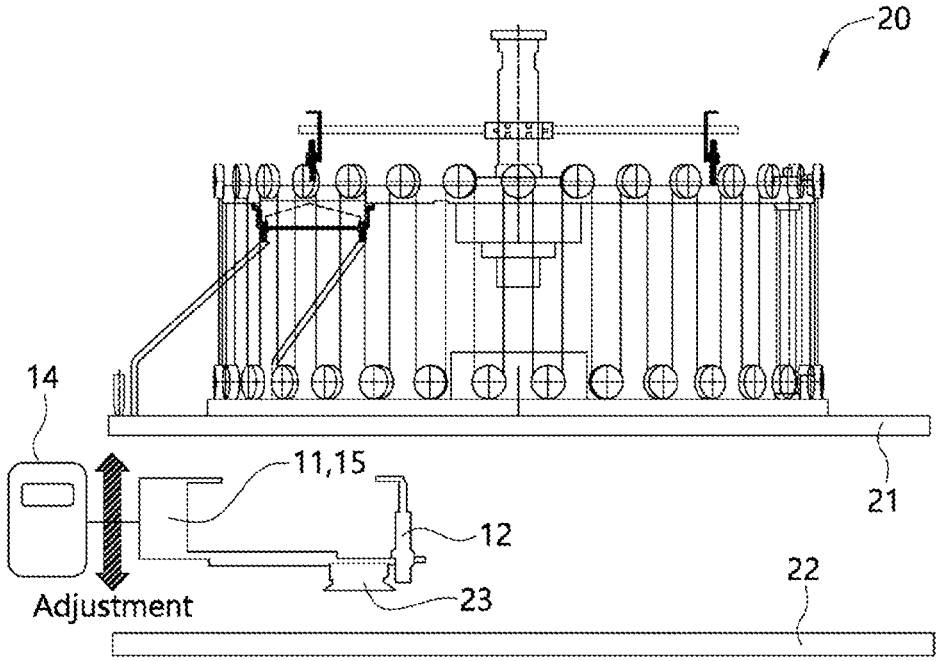

FIG. 2 is a block diagram of an automatic abrasion compensation system of a lower plate according to one embodiment of the present invention. Further, FIGS. 3 and 4 are conceptual views illustrating the use states of a wafer lapping apparatus having the automatic abrasion compensation system according to the present invention, and more particularly, FIG. 3 is a view illustrating the state in which reference distance information or measurement distance information between a transfer robot and a jig using the automatic abrasion compensation system are acquired, and FIG. 4 is a view illustrating the state in which a vertical distance of the transfer robot is adjusted through the reference distance information and the measurement distance information.

The wafer lapping apparatus shown in FIGS. 3 and 4 may be used by employing the automatic abrasion compensation system shown in FIG. 2, and thus, referring to FIGS. 2 to 4, the automatic abrasion compensation system and the wafer lapping apparatus having the same according to the present invention will be described together, and a detailed description of well-known structures and operating states thereby will be omitted for convenience.

An automatic abrasion compensation system 10 of a lower plate 22 according to the present invention uniformly adjusts the distance between a transfer robot 11 configured to load and unload wafers on and from the lower plate 22, and the lower plate 22. As shown in FIG. 2, the automatic abrasion compensation system 10 may include the transfer robot 11, an ultrasonic sensor 12, a jig 13, a controller 14 and a driver 15, and may further include a jig transfer unit 16. A wafer lapping apparatus 20 according to the invention may be understood as equipment having the above automatic abrasion compensation system 10.

As described above in the Related Art section, as the transfer robot 11 loads and unloads wafers on and from the lower plate 22 through 300 mm lapping equipment automation, the lower plate 22 becomes thinner due to friction between the lower plate 22 and an abrasive during the lapping process, and thus, the distance between the transfer robot 11 and the lower plate 22 is gradually increased. Therefore, Z-axis directional teaching of the position of a wafer by the transfer robot 11 is distorted, and thus causes wafer misloading and an error in distance measurement using the ultrasonic sensor 12.

Therefore, in the present invention, initial reference distance information S1 may be measured using the ultrasonic sensor 12 and the jig 13. That is, the reference distance information S1 may be acquired by mounting the jig 13 on the upper surface of the lower plate 22, for example, in a hole (not shown) formed in a carrier (not shown) coupled to the lower plate 22, and measuring the distance between the transfer robot 11 and the jig 13 using the ultrasonic sensor 12. For example, the reference distance information S1 may be distance information between the ultrasonic sensor 12 and the jig 13 mounted on the upper surface of the lower plate 22, which is initially measured after replacement with the lower plate 22.

The ultrasonic sensor 12 and a vacuum pad 23 may be connected to one side of the transfer robot 11, the configurations and the operating states of the ultrasonic sensor 12, the vacuum pad 23 and the transfer robot 11 are well known, and a detailed description thereof will thus be omitted.

The acquired reference distance information S1 may be stored in the controller 14. For this purpose, a separate memory (not shown) may be provided in the controller 14, and the controller 14 may include a monitor configured to display respective situation information. After the reference distance information S1 has been acquired, the jig 13 mounted on the lower plate 22 is removed, and the well-known lapping process is performed.

After the lapping process has been completed, the wafers are unloaded from the lower plate 22 by the transfer robot 11, and then, the lapping process for new wafers is prepared.

Here, prior to the lapping process for the new wafers, the jig is again mounted on the lower plate 22, and the distance between the transfer robot 11 and the jig 13 is measured using the ultrasonic sensor 12. Here, the distance serves as measurement distance information S2. The measurement distance information S2 may include the reference distance information S1 and the upper wear thickness of the lower plate 22.

That is, the lower plate 22 becomes thinner due to friction between the lower plate 22 and the abrasive during the lapping process, and thus, the distance between the transfer robot 11 and the lower plate 22 is gradually increased. Therefore, the measurement distance information S2 may be greater than the reference distance information S1 by the wear thickness of the lower plate 22, and the Z-axis position of the transfer robot 11 is adjusted to be lowered by a difference between the measurement distance information S2 and the reference distance information S1.

For this purpose, the controller 14 may generate an adjustment control signal C1. The adjustment control signal C1 may include driving control information of the driver 15 depending on the downward adjustment distance of the transfer robot 11. The driver 15 may include a driving servomotor configured to vertically move the transfer robot 11. For example, when the downward adjustment distance of the transfer robot 11 is 0.1 mm, the driving servomotor may be operated so as to move the transfer robot 11 downwards by 0.1 mm.

The jig may be mounted on the lower plate 22 so as to be located directly under the ultrasonic sensor 12. Further, the jig transfer unit 16 configured to transfer the jig 13 may be separately provided so as to automatically load and unload the jig 13 on and from the upper surface of the lower plate 22. The jig transfer unit 16 may be configured using a robot arm having the same structure as the transfer robot 11, and the jig transfer unit 16 may be connected to the controller 14 so as to be operated. Alternatively, a worker may manually load and unload the jig 13 on and from the upper surface of the lower plate 22.

The jig 13 may be unloaded from the lower plate 22 right after the reference distance information S1 and the measurement distance information S2 have been acquired.

After the transfer robot 11 has been adjusted to be moved downwards, the above-described lapping operation of wafers is performed. When the lapping operation of the wafers has been completed, the above-described process may be repeated.

During repetition of the above process, the transfer robot 11 is continuously adjusted to be moved downwards, and, when the transfer robot 11 is adjusted to be moved downwards by a designated distance or more, an upper plate 21 and the lower plate 22 should be replaced.

After replacement of the upper and lower plates 21 and 22 with new ones, the above-described process from measurement of reference distance information S1 may be repeated.

As described above, the automatic abrasion compensation system 10 according to the present invention may improve wafer misloading and errors occurring in wafer loading inspection, as described above, and may move the Z-axis position of the transfer robot 11 downwards by the wear thickness of the lower plate 22 so as to maintain a designated distance between the transfer robot 11 and the lower plate 22, thereby being capable of preventing reduction in efficiency and increase in a loss ratio in the wafer lapping apparatus 20.

As is apparent from the above description, an automatic abrasion compensation system of a lower plate and a wafer lapping apparatus having the same according to the present invention have the following effects.

First, the automatic abrasion compensation system may improve wafer misloading and errors occurring in wafer loading inspection.

Further, the automatic abrasion compensation system may move the Z-axis position of the transfer robot 11 downwards by the wear thickness of a lower plate so as to maintain a designated distance between a transfer robot and the lower plate, thereby being capable of preventing reduction in efficiency and increase in a loss ratio, which were conventionally caused, in the wafer lapping apparatus.

The features, structures, and effects described in association with the embodiments above are incorporated into at least one embodiment of the invention, but are not limited only to the one embodiment. Furthermore, the features, structures, and effects exemplified in association with respective embodiments can be implemented in other embodiments by combination or modification by those skilled in the art. Therefore, content related to such combinations and modifications should be construed as falling within the scope of the invention.

What is claimed is:

1. An automatic abrasion compensation system of a lower plate, configured to uniformly adjust a distance between the lower plate and a transfer robot configured to load and unload wafers on and from the lower plate, the automatic abrasion compensation system comprising:

an ultrasonic sensor and a vacuum pad provided on one side of the transfer robot;

a jig located directly under the ultrasonic sensor, and mounted on the lower plate;

a controller configured to acquire measurement distance information by measuring a distance from the jig through the ultrasonic sensor, to compare the measurement distance information with set reference distance information, and to generate an adjustment control signal;

a driver configured to automatically adjust a Z-axis position of the transfer robot depending on the adjustment control signal transmitted by the controller; and a jig transfer unit configured to load and unload the jig on and from the lower plate and is connected to be controlled by the controller.

2. The automatic abrasion compensation system according to claim 1, wherein the reference distance information is distance information between the ultrasonic sensor and the jig mounted on the lower plate, measured for the first time after replacement with the lower plate, wherein the measurement distance information is greater than the reference distance information by a wear thickness of the lower plate, the Z-axis position of the transfer robot is adjusted to be moved downwards by the wear thickness of the lower plate, wherein reference distance information is stored in the controller, the controller unit has a monitor configured to display respective situation information, and the jig is unloaded and removed from the lower plate after acquiring the reference distance information and the measured distance information.

3. A wafer lapping apparatus having the automatic abrasion compensation system according to claim 1.

* * * * *